US008095057B2

(12) United States Patent
Kim

(10) Patent No.: US 8,095,057 B2
(45) Date of Patent: Jan. 10, 2012

(54) TRANSFERRING UNIT AND IMAGE FORMING APPARATUS

(75) Inventor: Hun-sup Kim, Ansan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 807 days.

(21) Appl. No.: 12/107,341

(22) Filed: Apr. 22, 2008

(65) Prior Publication Data

US 2009/0010745 A1 Jan. 8, 2009

(30) Foreign Application Priority Data

Jul. 5, 2007 (KR) ..... 10-2007-0067698

(51) Int. Cl.
*G03G 15/16* (2006.01)

(52) U.S. Cl. ..... 399/317; 399/308; 399/313

(58) Field of Classification Search ..... 399/317, 399/302, 303, 308, 313, 228, 345
See application file for complete search history.

(56) References Cited

U.S. PATENT DOCUMENTS 5,983,062 A * 11/1999 Sameshima ..... 399/302
6,078,777 A * 6/2000 Imumi et al. ..... 399/313
6,862,421 B2 3/2005 Choi ..... 399/302
2004/0013452 A1 1/2004 Choi ..... 399/313
2005/0123326 A1 6/2005 Ito et al. ..... 399/313
2007/0196126 A1* 8/2007 Tanaka et al. ..... 399/313 X

FOREIGN PATENT DOCUMENTS

JP 5-333613 12/1993
JP 2001-249556 9/2001
JP 2001-356619 12/2001
KR 10-433424 5/2004

OTHER PUBLICATIONS

Search Report issued in European Patent Application No. 08159295.8 on Nov. 27, 2008.
Abstract of Korean Patent Application No. 2002-43012.

* cited by examiner

*Primary Examiner* — Sophia S Chen
(74) *Attorney, Agent, or Firm* — Staas & Halsey LLP

(57) ABSTRACT

A transferring unit of an image forming apparatus that includes: a contacted member; a rotating body that contacts and is spaced away from the contacted member; a rotating body transporting member where a supporting part to rotatably support the rotating body, a contacting external force receiving part to receive a contacting external force that contacts the rotating body with the contacted member, and a spacing external force receiving part to receive a spacing external force that spaces the rotating body away from the contacted member are formed in a single body; and a driver that drives the rotating body transporting member.

16 Claims, 12 Drawing Sheets

TRANSFERRING UNIT AND IMAGE FORMING APPARATUS

CROSS-REFERENCE TO RELATED APPLICATION

This application claims the benefit of Korean Application No. 2007-67698, filed Jul. 5, 2007 in the Korean Intellectual Property Office, the disclosure of which is incorporated herein by reference.

BACKGROUND OF THE INVENTION

1. Field of the Invention

Aspects of the present invention relate to an electrophotographic image forming apparatus, more particularly, to an image forming apparatus where the structure of the driving unit in a transferring unit is improved.

2. Description of the Related Art

An electrophotographic image forming apparatus is an apparatus for forming an image on a printing medium through a series of processes that include charging with electricity, exposing, developing, transferring and cleaning. The electrophotographic image forming apparatus includes a photosensitive body, an exposing unit (not shown) that exposes the photosensitive body according to image information, a developing unit (not shown) that develops the photosensitive body with a toner and forms a toner image on a surface of the photosensitive body, and a transferring unit.

In a multi-pass image forming apparatus that has a single photosensitive body and a single exposing unit in particular, the transferring unit includes a transferring belt, a middle transferring roller that transfers a toner image on the photosensitive body to the transferring belt, and a transferring roller that transfers the toner image on the transferring belt to a printing medium.

The multi-pass image forming apparatus develops the photosensitive body four times with different colors of toners such as yellow (Yel), magenta (Mag), cyan (Cyn) and black (Blk), respectively, thereby forming a color image. Then, the different colors of toners developed on a surface of the photosensitive body are transferred to the transferring belt by the middle transferring roller.

Accordingly, if the transferring belt circulates around a track four times, toner images of YelMagCynBlk colors on surface of the photosensitive body are sequentially and overlappingly transferred to the surface of the transferring belt, thereby forming a color toner image on the transferring belt. The color toner image is transferred by the transferring roller to the printing medium that passes through the transferring belt and the transferring roller.

Here, the transferring roller is spaced away from the transferring belt until the transferring belt circulates four times to completely form the color toner image thereon. Then, the transferring roller approaches the transferring roller to transfer the color toner image on the printing medium after completion of the color toner image on the transferring belt.

Thus, the transferring unit of the multi-pass type further includes a transferring roller driver that approaches the transferring roller to the transferring belt or spaces the transferring roller away from the transferring belt. The transferring roller driver is disclosed in Transfer Device of Color Laser Printer, KR Patent Application No. 2002-43012 (Transferring Apparatus of Color Laser Printer, Choi, U.S. Pat. No. 6,862,421) (hereinafter, referred to as "prior art").

The prior art regulates the position of the transferring roller, thereby forming a uniform transferring nip between the transferring belt and the transferring roller. On the other hand, the prior art has a complicated structure for bringing the transferring roller toward and spacing the transferring roller away from the transferring belt. In the prior art, parts are manufactured separately and then combined, in particular, a member applied with an elastic force so that the transferring roller approaches the transferring belt and a lever applied with a spacing external force so that the transferring roller is spaced away from the transferring roller by a. This separate manufacture followed by mechanical combination decreases productivity and increases cost.

SUMMARY OF THE INVENTION

Accordingly, it is an aspect of the present invention to provide a transferring unit that has a simple structure for approaching a rotating body (transferring roller) to and for spacing the rotating body away from a contacted member (transferring belt) in an image forming apparatus.

Another aspect of the present invention is to provide a transferring unit for an image forming apparatus with improved productivity and decreased cost.

Still another aspect of the present invention is to provide a transferring unit where a rotating body (transferring roller) presses a contacted body (transferring belt) uniformly along a lengthwise direction in an image forming apparatus.

Yet another aspect of the present invention is to provide a transferring unit that is capable of adjusting for defective contact of a rotating body (transferring roller) with a contacted member (transferring belt) in an image forming apparatus.

An example embodiment and other aspects of the present invention can be achieved by providing a transferring unit of an image forming apparatus including: a contacted member; a rotating body that is alternately contacted with and spaced away from the contacted member; in a single body, a rotating body transporting member with a supporting part to rotatably support the rotating body, a contacting external force receiving part to receive a contacting external force that contacts the rotating body with the contacted member, and a spacing external force receiving part to receive a spacing external force that spaces the rotating body away from the contacted member; and a driver that drives the rotating body transporting member.

According to an aspect of the invention, the contacted member includes a transferring belt where a toner image is applied, and the rotating body includes a transferring roller that transfers the toner image to a printing medium interposed between the transferring belt and the rotating body.

According to an aspect of the invention, the transferring unit further includes a position regulating shaft that is rotatable on a position regulating axis parallel with a rotating shaft of the rotating body, wherein the rotating body transporting member rotatably reciprocates between a contacting position where the rotating body contacts the contacted member and a spacing position where the rotating body is spaced away from the contacted member on the position regulating axis.

According to an aspect of the invention, the rotating body transporting member includes first and second rotating body transporting members that support opposite end portions of the rotating shaft of the rotating body, respectively.

According to an aspect of the invention, the first rotating body transporting member is combined with the position regulating shaft to interlockingly rotate the position regulating shaft when the position regulating shaft is rotating in a spacing rotation direction from the contacting position to the spacing position and then to release the position regulating shaft from interlocking rotation when the position regulating shaft is rotating in a reverse spacing rotation direction, and the second rotating body transporting member is combined with the position regulating shaft to receive the spacing external force from the position regulating shaft.

According to an aspect of the invention, the position regulating shaft includes a first surface contacting part, and the first rotating body transporting member includes a first shaft inserting part that has a first inserting space where the first surface contacting part is inserted; and a first contacting protrusion formed in an inner circumference of the first inserting hole to come in and out of contact with the first surface contacting part when the first surface contacting part is rotating in the spacing rotation direction and in the reverse spacing rotation direction, respectively.

According to an aspect of the invention, the first contacting protrusion and the first surface contacting part are spaced away from each other so that the first and second rotating body transporting members rotate separately at the contacting position.

According to an aspect of the invention, the position regulating shaft includes a second surface contacting part, and the second rotating body transporting member includes a second shaft inserting part that has a second inserting space where the second surface contacting part is inserted; and a second contacting protrusion formed in an inner circumference of the second inserting hole and contacted by the second surface contacting part to rotate in the spacing rotation direction.

According to an aspect of the invention, the first and second rotating body transporting members are combined with the position regulating shaft to be rotatable separately at the contacting position.

According to an aspect of the invention, the position regulating shaft includes a first surface contacting part, and the first rotating body transporting member includes a first shaft inserting part that has a first inserting hole where the first surface contacting part is inserted; and a first contacting protrusion formed in an inner circumference of the first inserting hole so as to be spaced away from the first surface contacting part as much as an independent rotation angle at the contacting position.

According to an aspect of the invention, the driver includes first and second elastic members that elastically push the first and second rotating body transporting members to the contacting position, respectively; and a pressing member that selectively presses one of the first and second rotating body transporting members to the spacing position.

According to an aspect of the invention, the driver includes first and second elastic members that elastically push the first and second rotating body transporting members to the contacting position, respectively; and first and second pressing members that selectively press one of the first and second rotating body transporting members to the spacing position, respectively.

Another example embodiment and other aspects of the present invention can be achieved by providing an image forming apparatus including: a contacted member; a rotating body that contacts and is spaced away from the contacted member; in a single body, a rotating body transporting member with a supporting part to rotatably support the rotating body, a contacting external force receiving part to receive a contacting external force that contacts the rotating body with the contacted member, and a spacing external force receiving part to receive a spacing external force that spaces the rotating body away from the contacted member; and a driver that drives the rotating body transporting member.

According to an aspect of the invention, the image forming apparatus further includes a position regulating shaft that is rotatable on a position regulating axis parallel with a rotating shaft of the rotating body, wherein the rotating body transporting member rotatably reciprocates between a contacting position where the rotating body contacts the contacted member and a spacing position where the rotating body is spaced away from the contacted member on the position regulating axis.

According to an aspect of the invention, the rotating body transporting member includes first and second rotating body transporting members that support opposite end portions of the rotating shaft of the rotating body, respectively.

According to an aspect of the invention, the first rotating body transporting member is combined with the position regulating shaft to interlockingly rotate the position regulating shaft when the position regulating shaft is rotating in a spacing rotation direction from the contacting position to the spacing position and then to release the position regulating shaft from interlocking rotation when the position regulating shaft is rotating in a reverse spacing rotation direction, and the second rotating body transporting member is combined with the position regulating shaft to receive the spacing external force from the position regulating shaft.

According to an aspect of the invention, the position regulating shaft includes a first surface contacting part, and the first rotating body transporting member includes a first shaft inserting part that has a first inserting space where the first surface contacting part is inserted; and a first contacting protrusion formed in an inner circumference of the first inserting space to come in and out of contact with the first surface contacting part when the first surface contacting part is rotating in the spacing rotation direction and in the reverse spacing rotation direction, respectively.

According to an aspect of the invention, the first contacting protrusion and the first surface contacting part are spaced away from each other so that the first and second rotating body transporting members rotate separately at the contacting position.

According to an aspect of the invention, the first and second rotating body transporting members are combined with the position regulating shaft to be rotatable separately at the contacting position.

According to an aspect of the invention, the driver includes first and second elastic members that elastically push the first and second rotating body transporting members to the contacting position, respectively; and a pressing member that selectively presses one of the first and second rotating body transporting members to the spacing position.

According to an aspect of the invention, the driver includes first and second elastic members that elastically push the first and second rotating body transporting members to the contacting position, respectively; and first and second pressing members that selectively press one of the first and second rotating body transporting members to the spacing position, respectively.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, in which.

DETAILED DESCRIPTION OF THE EMBODIMENTS

Figure 1:
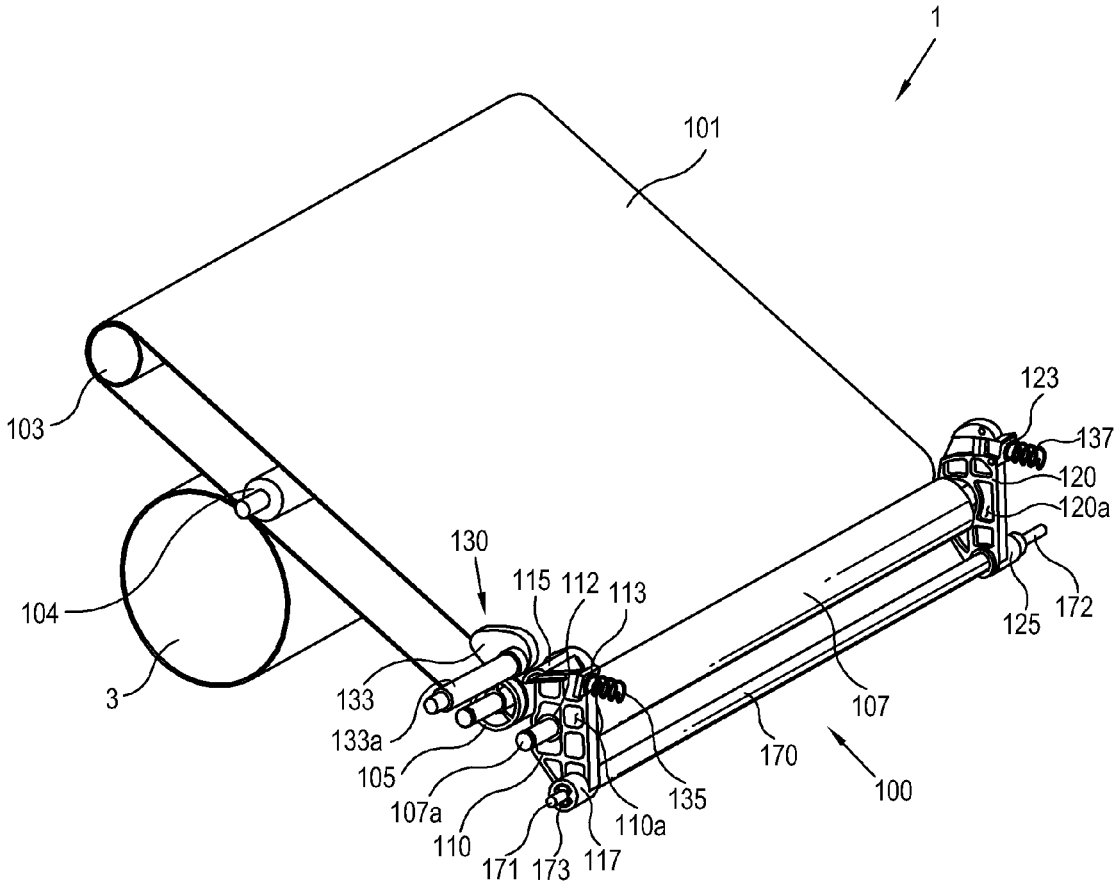
FIG. 1 is a schematic perspective view of an image forming apparatus according to a first example embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a perspective view illustrating the case where a transferring roller 107 is in contact with a transferring belt 101. As shown in FIG. 1, an image forming apparatus 1 includes an image receptor 3 where an electrostatic latent image corresponding to image information is formed, a developing unit (not shown) that develops the electrostatic latent image with a toner, and a transferring unit 100. The image forming apparatus 1 that is illustrated is a multi-pass type.

The image receptor 3 may be provided as a photosensitive drum. The image receptor 3 may also be provided as a photosensitive belt on which an organic photosensitive layer is applied. Also, an imaging drum may be used as the image receptor 3, where a plurality of minute electrodes is arranged on its surface to be applied with power, thereby forming the electrostatic latent image thereon. In this case, the image receptor 3 does not need to be exposed, and thus an exposing unit (not shown) may be omitted.

The developing unit (not shown) may be provided as a plurality of developing cartridges. Each of the cartridges (not shown) includes a toner storage unit that stores a toner with one of the YMCK colors; a supplying roller (not shown) that is disposed in the toner storage unit; and a developing roller (not shown) supplied with the toner by the supplying roller to develop the image receptor 3.

Figure 2:
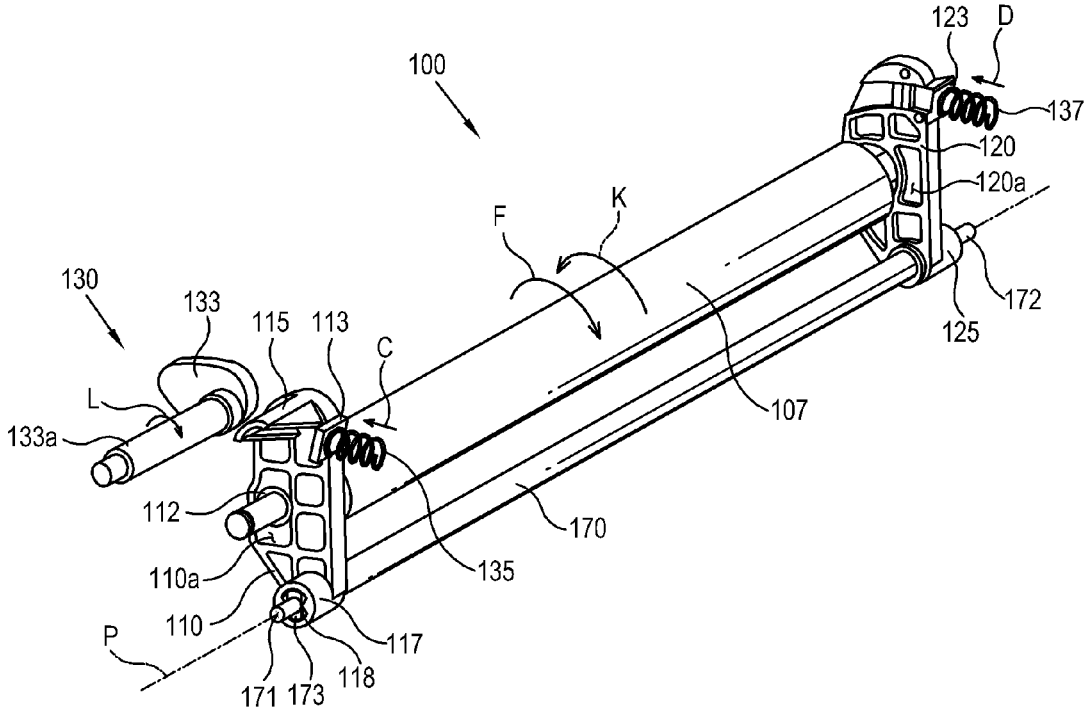
FIG. 2 is a perspective view of the main part of a transferring unit according to the first example embodiment of FIG. 1.

The transferring unit 100 transfers a toner image formed on the image receptor 3 to the transferring belt 101 and transfers a toner image on the transferring belt 101 to a printing medium. Referring to FIGS. 1 and 2, the transferring unit 100 includes the transferring belt 101, a transferring roller 107 that contacts or is spaced away from the transferring belt 101, transferring roller transporting members 110 and 120 that rotatably support the transferring roller 107 and are movable in a single body with the transferring roller 107, a driver 130 that drives the transferring roller transporting members 110 and 120, and a position regulating shaft 170 that regulates the position of the transferring roller transporting members 110 and 120.

Here, the transferring belt 101 may be referred to as a contacted member, the transferring roller 107, as a rotating body, and the transferring roller transporting members 110 and 120, as rotating body transporting members. Also, the transferring unit 100 may further include belt driving rollers 103 and 105 that cause the transferring belt 101 to circulate around a track and a middle transferring roller 104 disposed parallel with the image receptor 3 to transfer a toner image applied on a surface of the image receptor 3 to the transferring belt 101.

The transferring roller transporting members 110 and 120 are provided to rotatably reciprocate between a contacting position (see FIGS. 3A and 4A) where the transferring roller 107 contacts the transferring belt 101 and a spacing position (see FIGS. 3C and 4C) where the transferring roller 107 is spaced away from the transferring belt 101 on a position regulating axis P of the position regulating shaft 170. The transferring roller transporting members 110 and 120 include a first transferring roller transporting member 110 and a second transferring roller transporting member 120 that are each installed at opposite end portions of a rotating shaft 107*a* of the transferring roller 107. Here, reference numerals 110*a* and 120*a* in FIG. 1 represent a plurality of areas of first and second transferring roller transporting members 110 and 120 that are formed to be relatively thinner than the surrounding area so that the first and second transferring roller transporting members 110 and 120 become light in weight.

The transferring roller transporting members 110 and 120 include a first supporting part and a second supporting part 112 (in FIGS. 1, 2, and 3A-3C) and 122 (in FIGS. 4A-4C) that rotatably support the transferring roller 107, a first spacing external force receiving part and a second spacing external force receiving part 115 and 125, that receive a spacing external force to space the transferring roller 107 away from the transferring belt 101, and a first contacting external force receiving part and a second contacting external force receiving part 113 and 123, that receive a contacting external force to contact the transferring roller 107 to the transferring belt 101. The parts identified in this paragraph, 112, 113, 115, 122, 123 and 125, are formed integrally with the first and second transferring roller transporting members 110 and 120. Accordingly, not only is productivity improved, but cost is also reduced due to fewer number of components as compared with the prior art.

The first and second supporting parts 112 and 122 have a shaft space (no reference numbers assigned) where the rotating shaft 107*a* of the transferring roller 107 is inserted.

The first spacing external force receiving part 115 projects from the first transferring roller transporting member 110 to a cam 133 of a cam shaft 133*a*. Alternatively, the first spacing external force receiving part 115 may be modified variously as long as the transferring roller 107 contacts and is spaced away from the transferring belt 101 according to rotation of the cam 133.

Figure 3A:
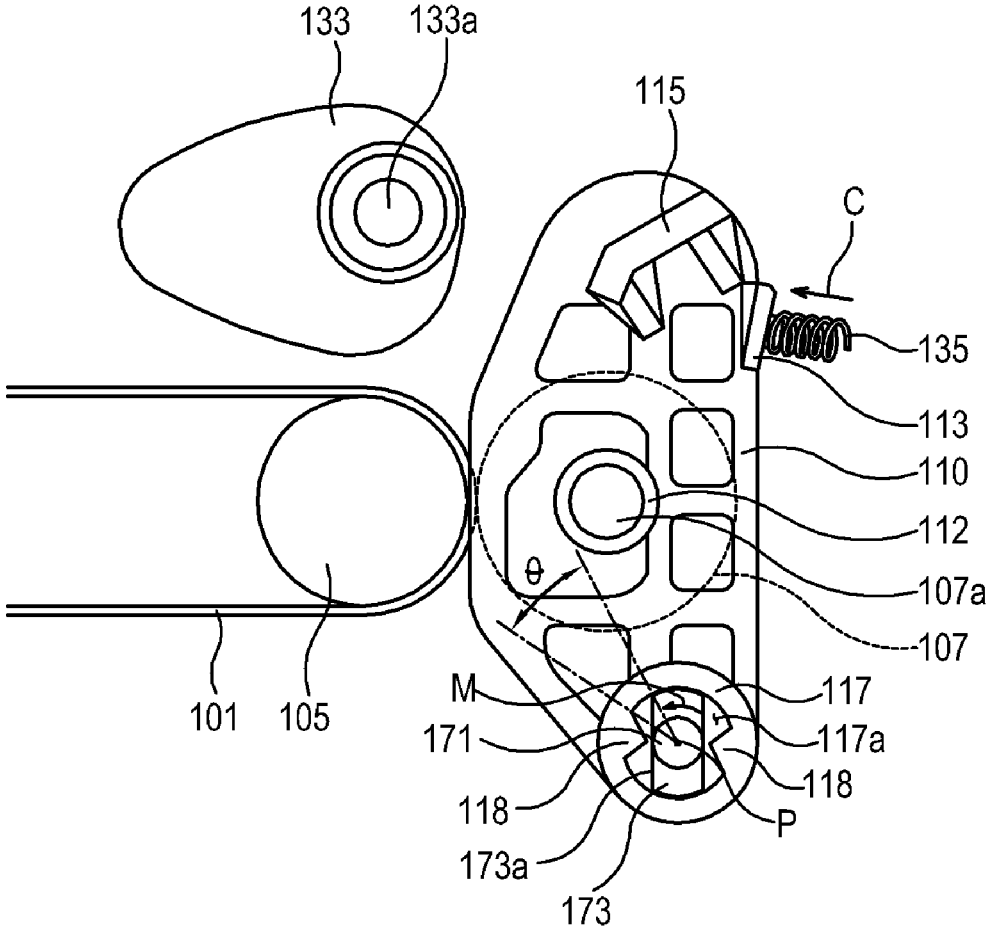
FIGS. 3A through 3C are a left lateral view to illustrate a process where a first rotating body transporting member of FIG. 2 moves from a contacting position to a spacing position.

Referring to FIGS. 2 and 3A, the first transferring roller transporting member 110 may further include a first shaft inserting part 117 having a first inserting space 117*a* where a first surface contacting part 173 of the position regulating shaft 170 is inserted, and a first contacting protrusion 118 formed in an inner circumference of the first inserting space 117*a* to come in and out of contact with the first surface contacting part 173.

The first contacting protrusion 118 contacts the first surface contacting part 173 if the first transferring roller transporting member 110 rotates in a spacing rotation direction F, that is, from the contacting position to the spacing position. Accordingly, the position regulating shaft 170 rotates on the position regulating axis P in the same direction as the spacing rotation direction F (see for example, FIG. 2). That is, the first contacting protrusion 118 applies a moment of rotation to the position regulating shaft 170 so that the position regulating shaft 170 rotates in the same direction as the spacing rotation direction F.

Further, as pictured, two first contacting protrusions 118 may be provided on opposite sides of the first surface contacting part 173 respectively. The first contacting protrusions 118 may be provided to contact the first surface contacting part 173 at the same time so that the first contacting protrusions 118 transmit a relatively high moment of rotation to the position regulating shaft 170. The first contacting protrusions 118 are not limited in shape and number as long as they contact the first surface contacting part 173 to rotate the position regulating shaft 170 in the spacing rotation direction F.

Conversely, the first contacting protrusion 118 comes out of contact with the first surface contacting part 173 if the first transferring roller transporting member 110 rotates in a reverse spacing rotation direction, i.e., contacting direction K (also see, for example, FIG. 2). That is, the first transferring roller transporting member 110 is now not interrupted by the position regulating shaft 170 but moves to the contacting position.

Figure 4A:
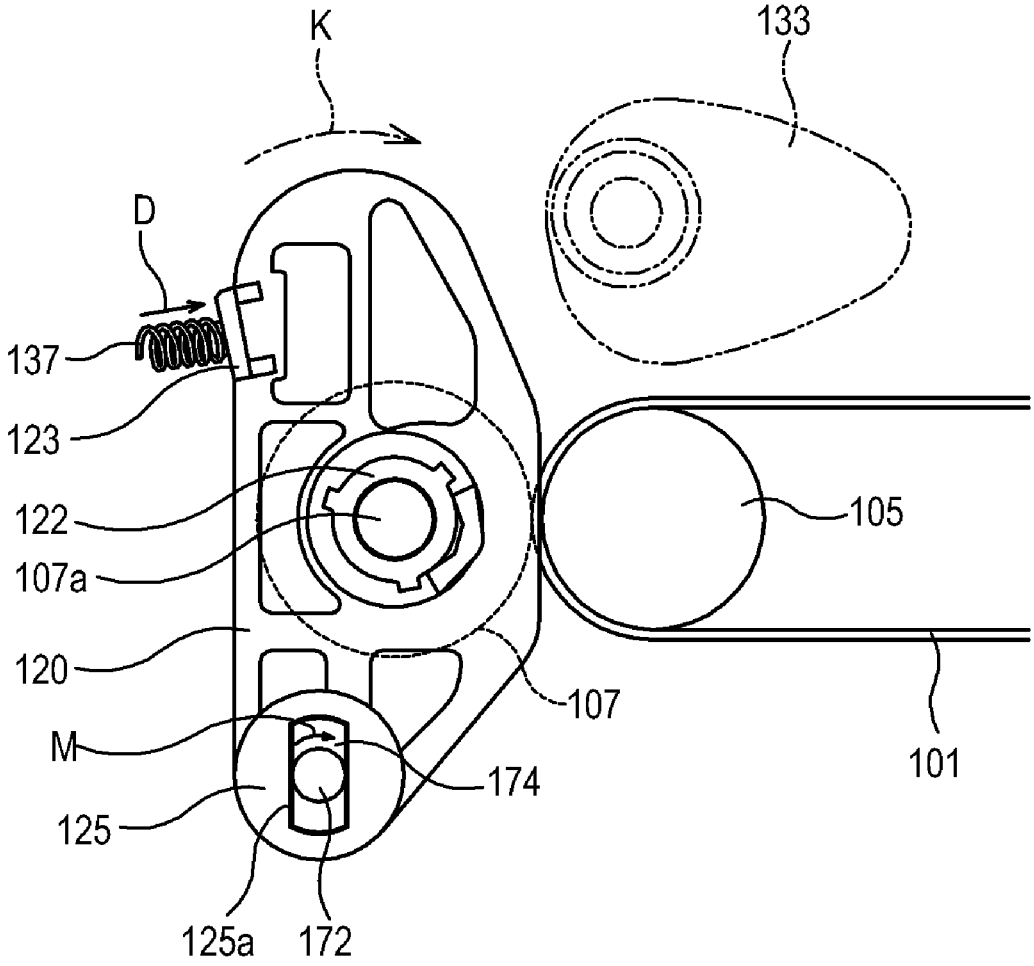
FIGS. 4A through 4C are a right lateral view to illustrate a process where a second rotating body transporting member of FIG. 2 moves from a contacting position to a spacing position.
Figure 4B:
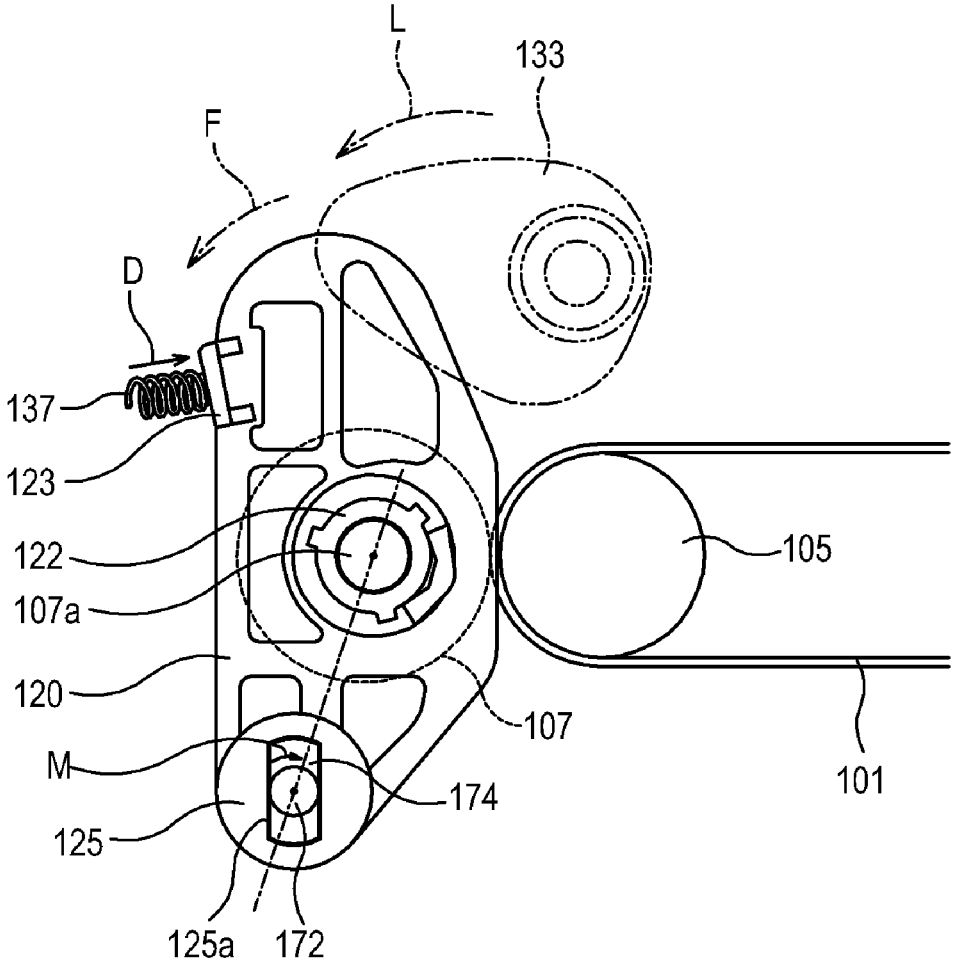

Meanwhile, on the other side of the transferring unit 110, the second spacing external force receiving part 125 is provided to receive a spacing external force from the position regulating shaft 170 in order to rotate the second transferring roller transporting member 120 in the spacing rotation direction F. Referring to FIG. 4A, for example, a second inserting space 125*a* may be formed corresponding to the shape of a second surface contacting part 174 of the position regulating shaft 170 along the position regulating axis P. Accordingly, the second transferring roller transporting member 120 may rotatably move in the spacing rotation direction F in the same way as the position regulating shaft 170 is rotated by the first contacting protrusion 118 in the spacing rotation direction F.

Figure 7:
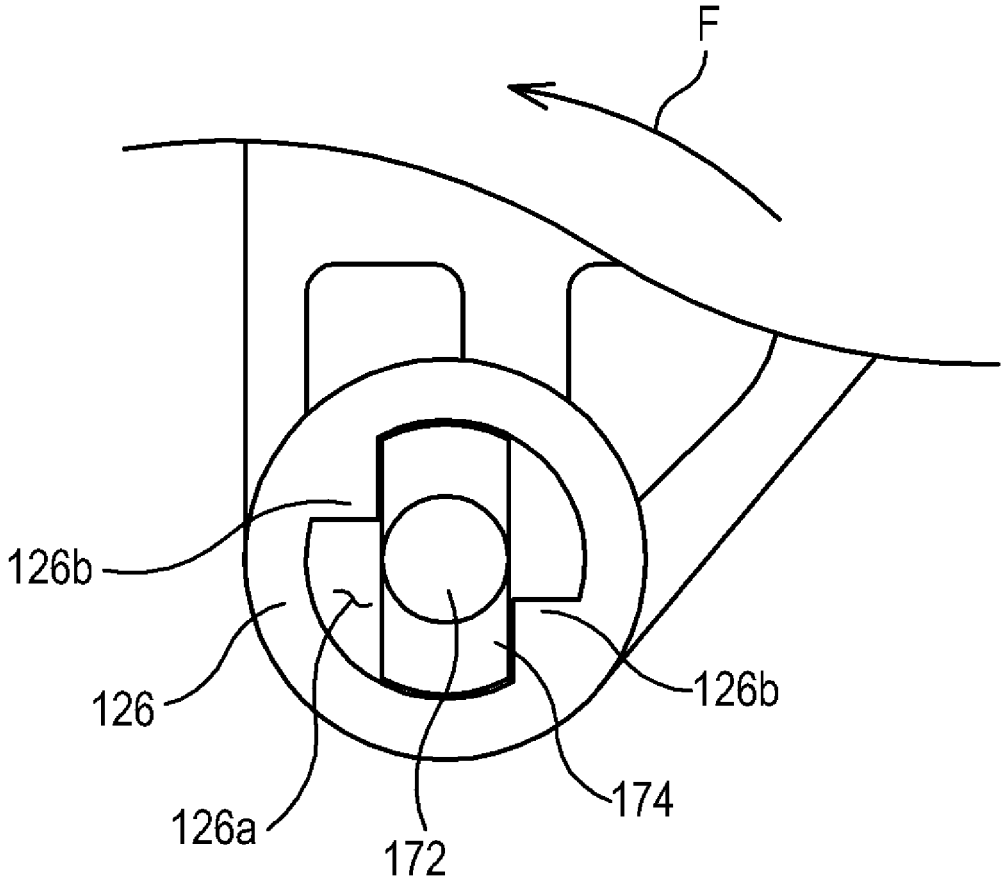
FIG. 7 is a right lateral view to illustrate a second rotating body transporting member that has a different-shaped spacing external force receiving part than that shown in FIG. 4A.

The second spacing external force receiving part 125 may be modified in shape. For example, in the embodiment of FIG. 7, the second spacing external force receiving part 126 includes a second inserting space 126*a* of a circular shape that does not correspond to the shape of the second surface contacting part 174 as well as a second contacting protrusion 126*b*.

The second contacting protrusion 126*b* may be provided in the inner circumference of the second inserting space 126*a* so that the second contacting protrusion 126*b* contacts the second surface contacting part 174 to rotate the second transferring roller transporting member 120 in the spacing rotation direction F by the position regulating shaft 170.

Further, as pictured, two second contacting protrusions 126*b* may be disposed on opposite sides of the second surface contacting part respectively In this way, the second contacting protrusions 126*b* may also contact the second surface contacting part 174 at the same time so that the second contacting protrusions 126*b* may also transmit a relatively high moment of rotation to the position regulating shaft 170.

Meanwhile, the first and second contacting external force receiving parts 113 and 123 may be provided to project so that a first elastic member and a second elastic member 135 and 137 respectively (discussed later) are easily combined. The driver 130 includes the cam 133 that is rotatable on the cam shaft 133*a* parallel with the position regulating shaft 170 and the first and second elastic members 135 and 137. Here, the cam 133 may also be referred to as a pressing member.

The cam 133 presses the first spacing external force receiving part 115 of the first transferring roller transporting member 110, thereby rotating the first transferring roller transporting member 110 on the position regulating axis P in the direction F where the transferring roller 107 is spaced away from the transferring belt 101. As necessary, the cam 133 may be provided to press the second transferring roller transporting member 120, not the first transferring roller transporting member 110. In this case, the first spacing external force receiving part 115 is formed on the second transferring roller transporting member 120, not on the first transferring roller transporting member 110. Now, the second spacing external force receiving part 125 of the second transferring roller transporting member 120 does not receive an external force from the first transferring roller transporting member 110, but transmits an external force to the first transferring roller transporting member 110.

The first and second elastic member 135 and 137 are each connected at one end with the contacting external force receiving parts 113 and 123 respectively of the transferring roller transporting members 110 and 120 and with a frame (not shown) at their other ends, thereby applying an elastic force to the respective transferring roller transporting members 110 and 120 in the C and D directions shown in FIGS. 3A and 4A at the point where the transferring roller 107 is in contact with the transferring belt 101. Here, the modulus of elasticity of the second elastic member 137 is set so that the second transferring roller transporting member 130 can overcome the elastic force of the second elastic member 137 so that in turn the position regulating shaft 170 can rotate to properly place the transferring roller 107.

The position regulating shaft 170 includes opposite end parts 171 and 172 rotatably supported and the first and second surface contacting parts 173 and 174 in FIG. 4A that are disposed in the first and second inserting spaces 117*a* and 125*a* of the first and second transferring roller transporting members 110 and 120. The end parts 171 and 172 and the first and second surface contacting parts 173 and 174 in FIG. 4A may be formed in a single body.

Hereinafter, with reference to FIGS. 3A through 3C and 4A through 4C, the process will be described for moving the first and second transferring roller transporting members 110 and 120 from the contacting position to the spacing position. The moving process for the first transferring roller transporting member 110 shown in FIGS. 3A through 3C corresponds to the moving process for the second transferring roller transporting member 120 shown in FIGS. 4A through 4C.

Referring to FIGS. 3A and 4A, the first and second transferring roller transporting members 110 and 120 are positioned in the contacting position of the transferring roller 107 with the transferring belt 101 by the elastic forces of the first and second elastic members 135 and 137 applied in directions of C and D, respectively, until the cam 133 contacts the first spacing external force receiving part 115. In the contacting position a spacing space may be provided between the first contacting protrusion 118 and the first surface contacting part 173 at. The spacing space, as shown in FIG. 3A, may provide for a separate rotation angle of θ, the value of which is a design feature. That is, the first transferring roller transporting member 110 and the position regulating shaft 170 may separately and rotatably move as long as one of the first contacting protrusions 118 and the first surface contacting part 173 rotates up to the separate rotation angle of θ but the two structures do not contact with each other. Accordingly, the first transferring roller transporting member 110 and the position regulating shaft 170 rotate separately, and therefore, the first and second transferring roller transporting members 110 and 120 rotate separately.

Referring now to FIG. 4A, inasmuch as the position regulating shaft 170 and the second transferring roller transporting member 120 are movable as a single body with the second surface contacting part 174 and the second spacing external force receiving part 125, the second elastic member 137 continually applies a moment of rotation in the direction of K against the second transferring roller transporting member 120. Accordingly, the position regulating shaft 170 is indirectly applied with the same moment of rotation by the second transferring roller transporting member 120, such that the position regulating shaft is rotated in the direction of M as shown FIG. 3A. Therefore, the spacing space is provided between the first contacting protrusion 118 and the first surface contacting part 173 so that the first and second transferring roller transporting members 110 and 120 can separately rotate. Accordingly, opposite end parts 171 and 172 of the transferring roller 107 that are supported by the first transferring roller transporting member 110 and the second transferring roller transporting member 120, respectively may rotate at different angles on the position regulating axis P, and thus the transferring roller 107 can contact with the transferring belt 101 at comparatively regular pressure.

If the first and second transferring roller transporting members 110 and 120 are designed to rotate as a single body, they rotate at a uniform angle on the position regulating axis P. Accordingly, a portion of the transferring roller 107 may not contact with, but be spaced away from the transferring belt 101 because of inaccuracies in design and the like of the belt driving roller. In the present example embodiment of the present invention, however, the first and second transferring roller transporting members 110 and 120 may rotate separately, and thus such a defective contacting problem is not likely to arise.

As long as the first and second transferring roller transporting members 110 and 120 are provided to rotate as a single body, the defective contact problem may not easily be settled by adjusting the elastic forces of the first and second elastic members 135 and 137 because opposite end parts of the first and second transferring roller transporting members 110 and 120 are applied with half of the resultant force of elastic forces of the first and second elastic members 135 and 137.

In the present example embodiment, on the other hand, the first and second transferring roller transporting members 110 and 120 rotate separately at the contacting position, thereby the defective contacting problem can easily be avoided by adjusting the elastic forces of the first and second elastic members 135 and 137 separately. This relates to durability of the image forming apparatus. If the image forming apparatus is used for a long time, the elastic forces on the elastic members 135 and 137 may change, and thus the defective contact problem may arise. In the present example embodiment, the defective contacting problem can be settled easily by replacing the elastic members 135 and 137 with new elastic members.

Figure 3B:
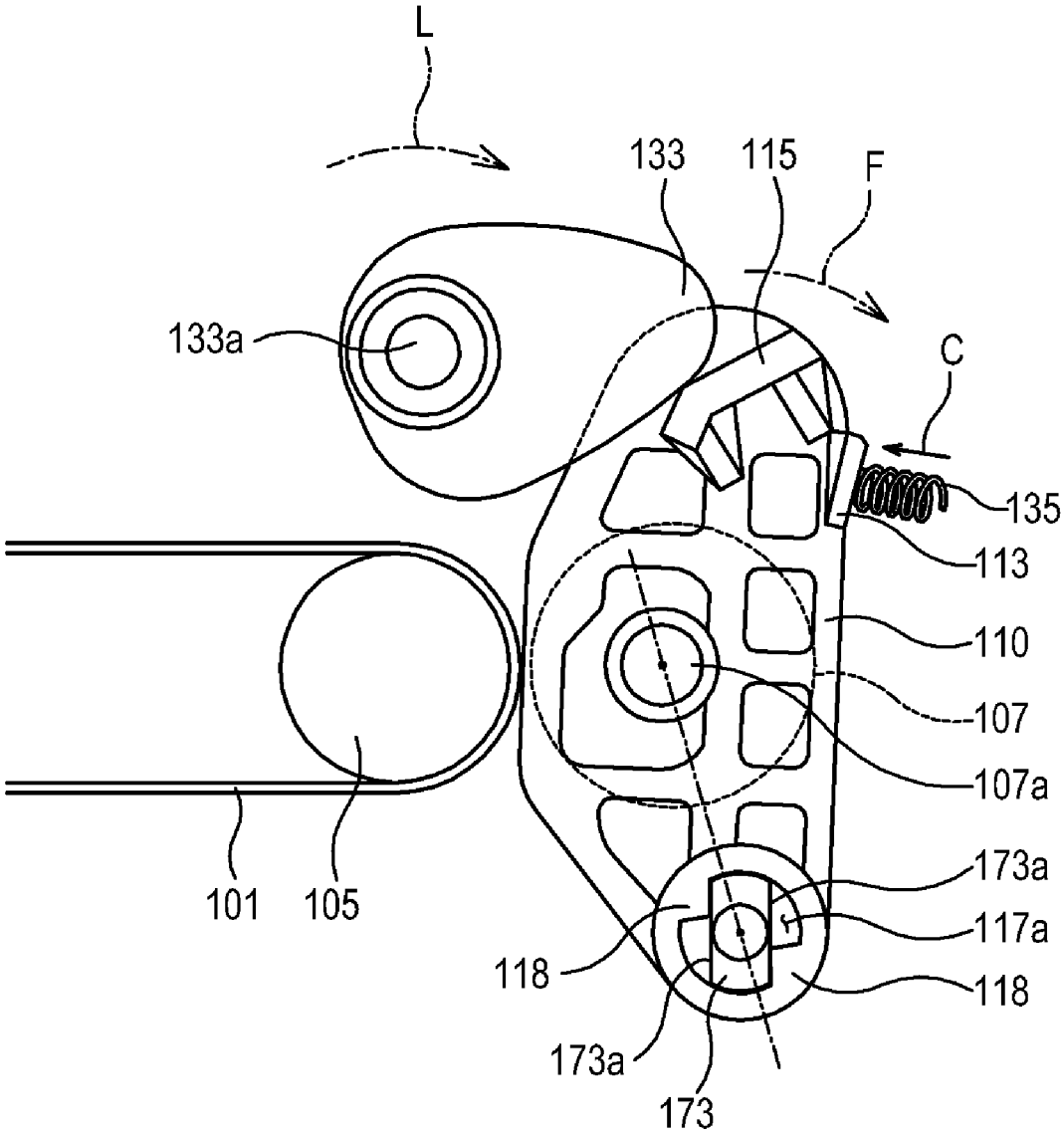

Referring now to FIG. 3B, if the cam 133 rotates to press the first spacing external force receiving part 115, the first transferring roller transporting member 110 rotates in the spacing rotation direction F. The position regulating shaft 170 is idle until the first contacting protrusion 118 rotates up to the separate rotation angle θ (see FIG. 3A) to contact the contact surface 173*a* of the first surface contacting part 173 of the position regulating shaft 170. Accordingly, now referring to FIG. 4B, the second transferring roller transporting member 120 is still positioned at the contact position of FIG. 4A. That is, the transferring roller 107 is now spaced away from the transferring belt 101 toward the first transferring roller transporting member 110 (see FIG. 3A), but still in contact with the transferring belt 101 toward the location of the second transferring roller transporting member 120.

Figure 3C:
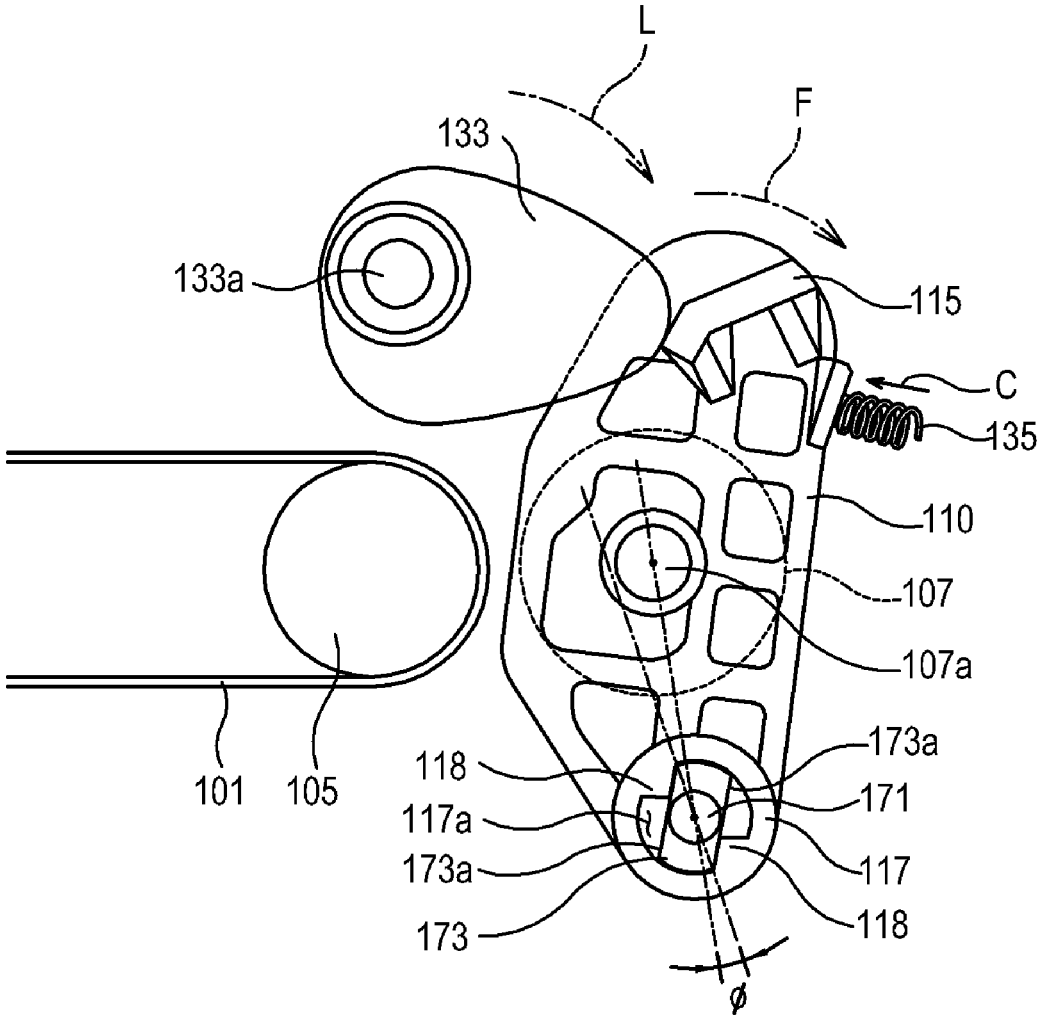
Figure 4C:
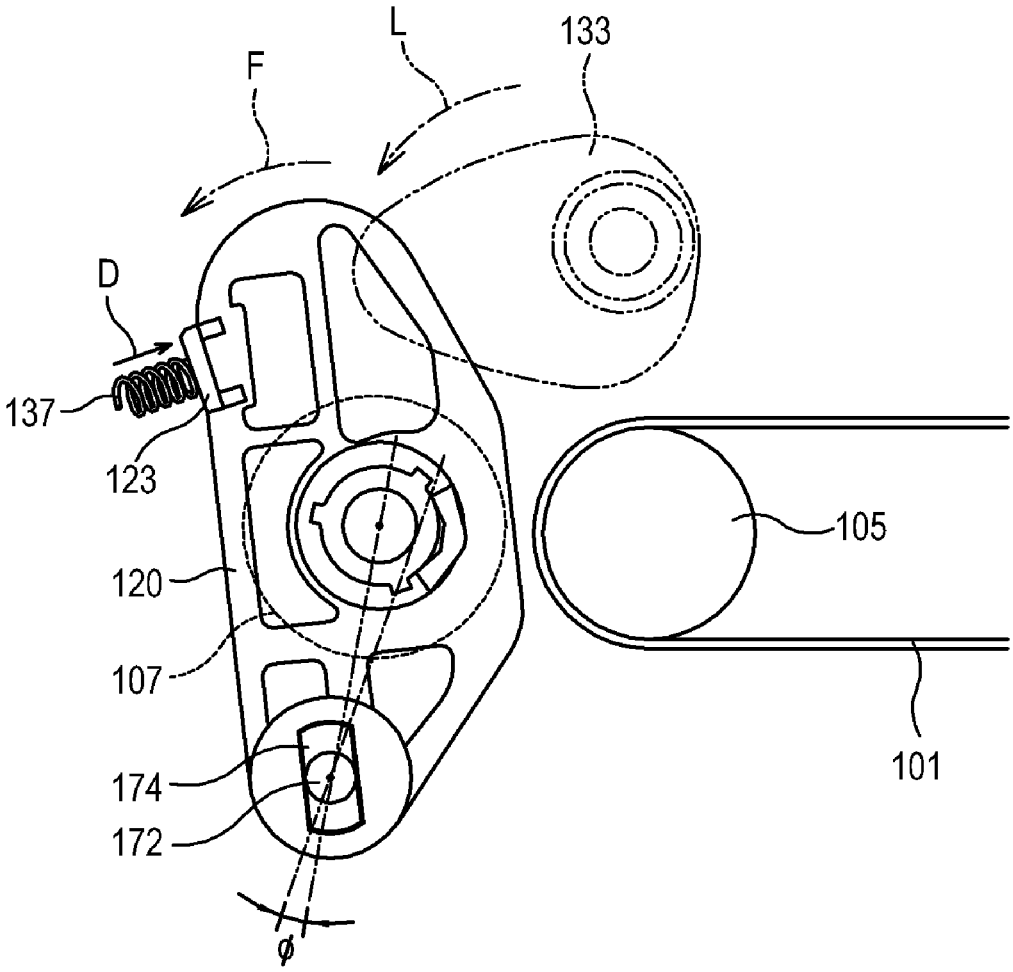

Now referring to FIGS. 3C and 4C, if the cam 133 further rotates to push the first transferring roller transporting member 110 further in the spacing rotation direction F, both first and second transferring roller transporting members 110 and 120 rotate up to an angle of ϕ in the spacing rotation direction F. Accordingly, the transferring roller 107 is now entirely spaced away from the transferring belt 101. The rotation angle of ϕ can vary according to the designed shape of the cam 133 and the designed shape of the first spacing external force receiving part 115. The rotation angle of ϕ has a value enough for the entire transferring roller 107 to be spaced away from the transferring belt 101 so that an incomplete toner image is not transferred to the transferring roller 107.

Figure 5:
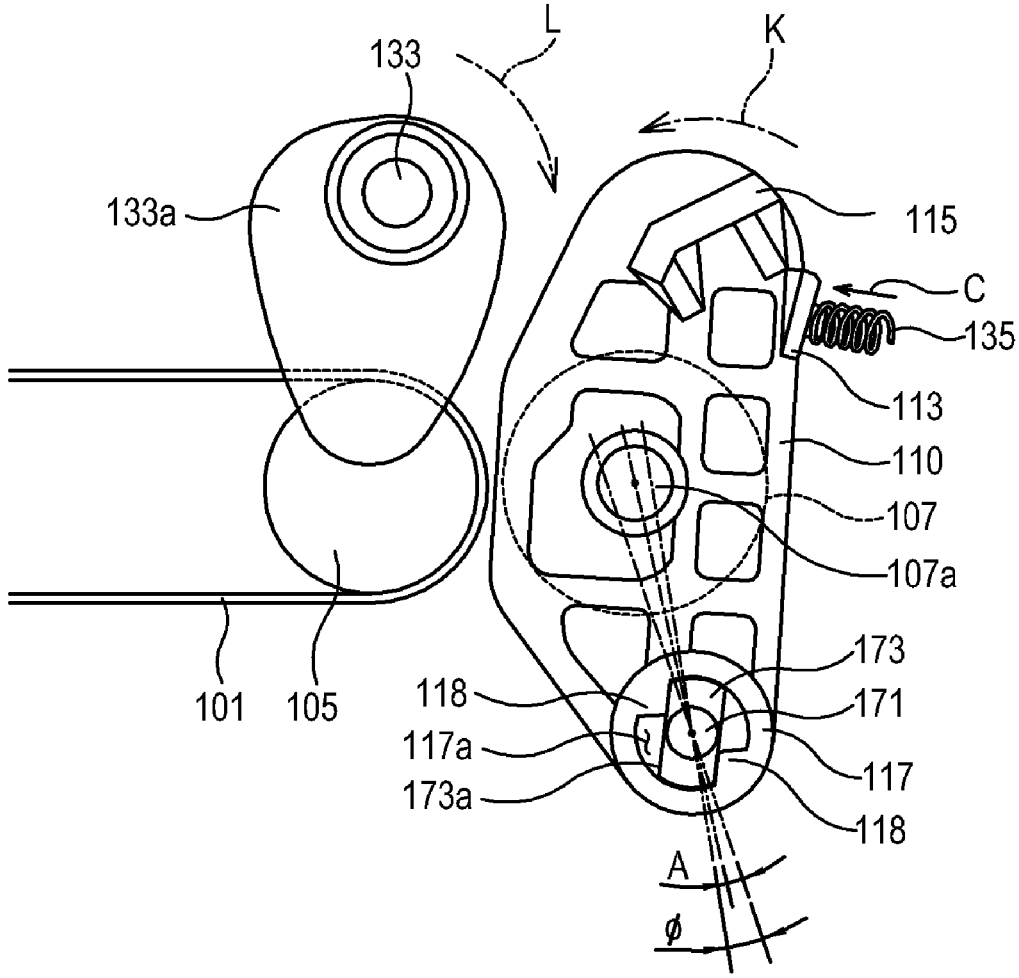
FIG. 5 is a left lateral view to illustrate a process where the first rotating body transporting member of FIG. 2 returns to the contacting position.
Figure 6:
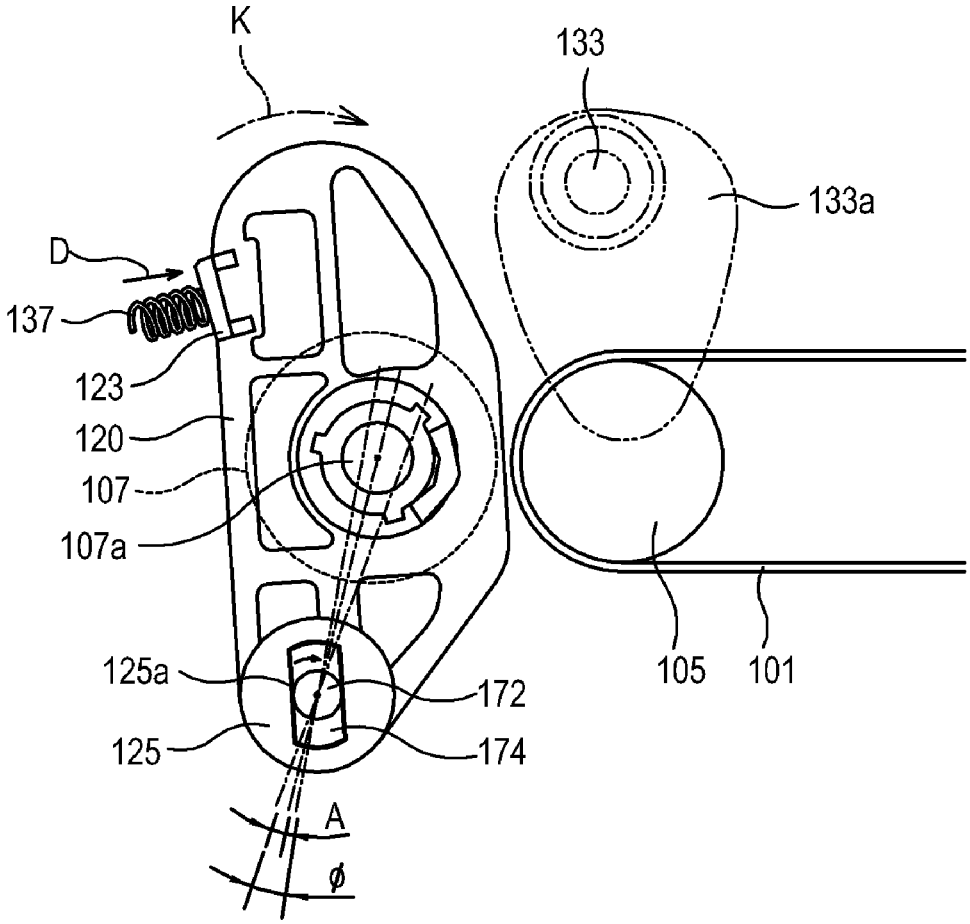
FIG. 6 is a right lateral view to illustrate a process where the second rotating body transporting member of FIG. 2 returns to the contacting position.

Now, with reference to FIGS. 5 and 6, the process will be described where the first and second transferring roller transporting members 110 and 120 return from the spacing position (see FIGS. 3C and 4C) to the contacting position (see FIGS. 3A and 4A). FIGS. 5 and 6 illustrate right and left lateral views of the transferring roller transporting members 110 and 120 that are rotated as much as an angle of A in the reverse spacing rotation direction K from the spacing position with the rotation angle of ϕ, respectively.

If the cam 133 rotates further in the direction of L, the first spacing external force receiving part 115 is now spaced away from the cam 133, and thus the first transferring roller transporting member 110 is rotated by the first elastic member 135 in the reverse spacing rotation direction K. Here, the first contacting protrusion 118 is spaced away from the first surface contacting part 173 of the position regulating shaft 170, and accordingly the first transferring roller transporting member 110 and the position regulating shaft 170 are released from interlocking rotation. Namely, the first transferring roller transporting member 110 rotates independently of the position regulating shaft 170 and returns to the contacting position in FIG. 3A. However, if the second elastic member 137 has a stronger elastic force than the first elastic member 135, the speed of rotation of the first surface contacting part 173 is faster than that of the first transferring roller transporting member 110. Thus, while the first transferring roller transporting member 110 rotates in the reverse spacing rotation direction K, as the first surface contacting part 173 and the first contacting protrusion 118 maintain contact, the first transferring roller transporting member 110 and the position regulating shaft 170 may not be released from the interlocking rotation. Meanwhile, if the transferring roller 107 is in contact with the transferring belt 101, the first transferring roller transporting member 110 returns to the contacting position illustrated in FIG. 3A.

Referring now to FIG. 6, the second transferring roller transporting member 120 rotates along with the position regulating shaft 170 in the reverse spacing rotation direction K because of the elastic force of the second elastic member 137 and the second surface contacting part 174 being inserted into the second inserting space 125*a*. Then, if the transferring roller 107 comes in contact with the transferring belt 101 and can not be rotated further, the second transferring roller transporting member 120 is now also positioned at the contacting position in FIG. 4A.

Figure 8:
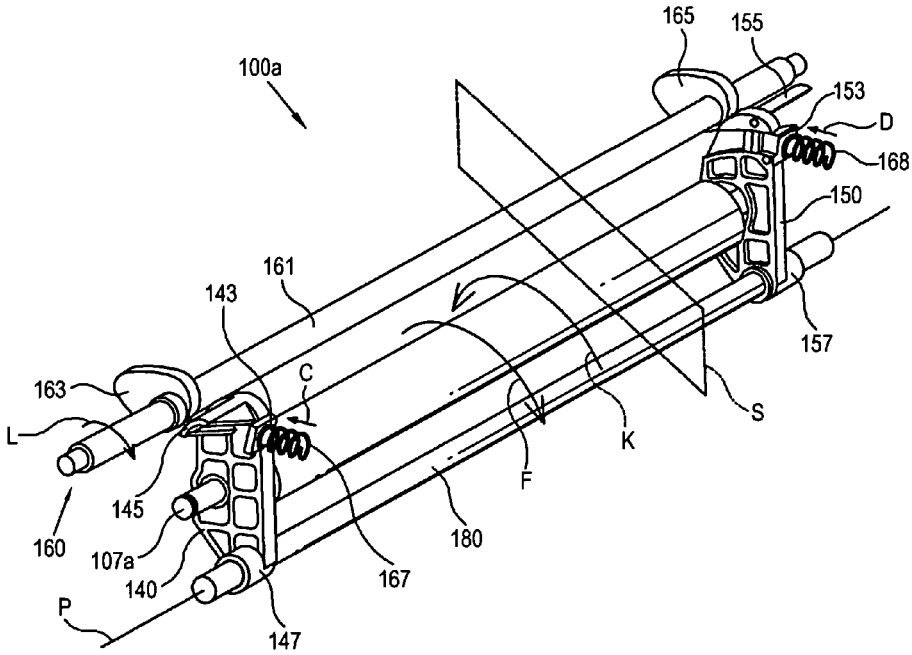
FIG. 8 is a perspective view of the main part of a transferring unit according to a second example embodiment of the present invention.

Hereinafter, a transferring unit 100*a* according to a second example embodiment of the present invention will be described with reference to FIG. 8. The transferring unit 100*a* includes a first transferring roller transporting member and a second transferring roller transporting member 140 and 150, a driver 160 to drive the transferring roller transporting members 140 and 150, and a position regulating shaft 180.

The first and second transferring roller transporting members 140 and 150 include a first contacting external force receiving part and a second contacting external force receiving part 143 and 153 that receive a contacting external force, a first spacing external force receiving part and a second spacing external force receiving part 145 and 155 that receive a spacing external force, and a first shaft inserting part and a second shaft inserting part 147 and 157 where the position regulating shaft 180 is inserted, respectively. The first and second transferring roller transporting members 140 and 150 are formed as a single body, respectively. In this example embodiment, the first and second transferring roller transporting members 140 and 150 may be symmetrical on a cross-section surface S that is normal to the rotation axis of the transferring roller 107.

Unlike the first example embodiment, in the present example embodiment, the position regulating shaft 180 does not interlockingly rotate with the first and second transferring roller transporting members 140 and 150. That is, the position regulating shaft 180 does not have first and second surface contacting parts, that are provided in the first exemplary embodiment, and the position regulating shaft 180 is inserted into the first and second shaft inserting parts 147 and 157 to provide a common rotation axis for the first and second transferring roller transporting members 140 and 150. Accordingly, the first and second transferring roller transporting members 140 and 150 may rotate independently of each other, while they independently rotate only in the spacing space where the first surface contacting part 173 in FIG. 3A and the first contacting protrusion 118 in FIG. 3A are not in contact with each other in the first example embodiment.

Meanwhile, the first and second spacing external force receiving parts 145 and 155 project along a position regulating axis P, thereby being pressed by a first cam and a second cam 163 and 165. The driver 160 includes the first and second cams 163 and 165 that selectively press the first and second transferring roller transporting members 140 and 150 respectively, and a first elastic member and a second elastic member 167 and 168 connected to the first and second contacting external force receiving parts 143 and 153 to apply an elastic force to the first and second transferring roller transporting members 140 and 150 so that the transferring roller 107 comes in contact with the transferring belt 101 (see FIG. 1). The first and second cams 163 and 165 are provided to be rotatable on a common cam shaft 161 parallel with a rotating shaft 107*a* of the transferring roller 107.

Hereinafter, the operating cycle of the transferring unit 100*a* with the foregoing configuration according to the second example embodiment will be explained. If it is at the point in the operating cycle where the transferring roller 107 is to be spaced away from the transferring belt 101, the first and second cams 163 and 165 are rotated in a direction of L to press the first and second transferring roller transporting members 140 and 150. Conversely, if it is at the point in the operating cycle where the transferring roller 107 is to be in contact with the transferring belt 101, the first and second cams 163 and 165 are rotated further in the direction of L to release the pressure on the first and second transferring roller transporting members 140 and 150. Accordingly, by elastic forces of the first and second elastic members 167 and 168, the transferring roller 107 may now return to a contacting position where it is in contact with the transferring belt 101.

In the second example embodiment, similar to the first example embodiment, the first and second transferring roller transporting members 140 and 150 are formed in a single body, respectively, thereby improving productivity and reducing cost. Further, the first and second transferring roller transporting members 140 and 150 rotate separately from each other, thereby avoiding the defective contacting problem discussed above by adjusting the elastic forces of the first and second elastic members 167 and 168 independently.

In the aforementioned description, the transferring belt 107 contacts the transferring belt 101 in the image forming apparatus. However, the present invention may be applicable for an image forming apparatus of a non-contact type that includes a predetermined transferring gap and where the transferring roller 107 approaches and is spaced away from the transferring belt 101, as necessary.

Also, the present invention is illustrated as an example with a multi-pass electrophotographic image forming apparatus, but may apply to a single-pass, ink-jet or thermoelectronic image forming apparatus as long as a rotating body needs to be in contact with or approach and then be spaced away from a contacted body.

As described above, aspects of the present invention provide a transferring unit that has a simple structure to approach toward and space away a rotating body (transferring roller) from a contacted member (transferring belt) and an image forming apparatus.

Second, aspects of the present invention provide a transferring unit and an image forming apparatus that can be produced with more efficiency and at reduced cost.

Further, aspects of the present invention provides a transferring unit and an image forming apparatus where a rotating body (transferring roller) presses a contacted body (transferring belt) uniformly along a lengthwise direction.

Lastly, aspects of the present invention provide a transferring unit and an image forming apparatus that are capable of adjusting for a defective contact of a rotating body (transferring roller) to a contacted member (transferring belt) by replacing a used elastic member with a new one Although a few embodiments of the present invention have been shown and described, it would be appreciated by those skilled in the art that changes may be made in these embodiments without departing from the principles and spirit of the invention, the scope of which is defined in the appended claims and their equivalents

What is claimed is:

1. A transferring unit of an image forming apparatus comprising:

a contacted member;

a rotating body that is alternately contacted with and spaced away from the contacted member;

in a single body, a first and a second rotating body transporting members where a supporting part to rotatably support the rotating body, a contacting external force receiving part to receive a contacting external force that contacts the rotating body with the contacted member, and a spacing external force receiving part to receive a spacing external force that spaces the rotating body away from the contacted member are formed, the first and the second rotating body transporting members supporting opposite end portions of a rotating shaft of the rotating body, respectively;

a driver that drives the first rotating body transporting member; and a position regulating shaft that is inserted into the first and second rotating body transporting members and is rotatable on a position regulating axis parallel with the rotating shaft of the rotating body, the first rotating body transporting member contacting the position regulating shaft to rotate the position regulating shaft after the first rotating body transporting member is rotated by the driver by a predetermined angle, and then the second rotating body transporting member being interlockingly rotated by the position regulating shaft.

2. The transferring unit according to claim 1, wherein the contacted member comprises a transferring belt where a toner image is applied, and the rotating body comprises a transferring roller that transfers the toner image to a printing medium interposed between the transferring belt and the rotating body.

3. The transferring unit according to claim 1, wherein the first and the second rotating body transporting members rotatably reciprocate between a contacting position where the rotating body contacts the contacted member and a spacing position where the rotating body is spaced away from the contacted member on the position regulating axis.

4. The transferring unit according to claim 1, wherein the driver comprises first and second elastic members that elastically bias the first and second rotating body transporting members to the contacting position, respectively; and a pressing member that selectively presses one of the first and second rotating body transporting members to the spacing position.

5. The transferring unit according to claim 1, wherein the driver comprises first and second elastic members that elastically bias the first and second rotating body transporting members to the contacting position, respectively; and first and second pressing members that selectively press the first and second rotating body transporting members to the spacing position, respectively.

6. A transferring unit of an image forming apparatus comprising:

a contacted member;

a rotating body that is alternately contacted with and spaced away from the contacted member;

in a single body, a rotating body transporting member where a supporting part to rotatably support the rotating body, a contacting external force receiving part to receive a contacting external force that contacts the rotating body with the contacted member, and a spacing external force receiving part to receive a spacing external force that spaces the rotating body away from the contacted member are formed;

a driver that drives the rotating body transporting member; and a position regulating shaft that is rotatable on a position regulating axis parallel with the rotating shaft of the rotating body, wherein the rotating body transporting member rotatably reciprocates between a contacting position where the rotating body contacts the contacted member and a spacing position where the rotating body is spaced away from the contacted member on the position regulating axis, wherein the rotating body transporting member comprises first and second rotating body transporting members that support opposite end portions of a rotating shaft of the rotating body, respectively, and wherein the first rotating body transporting member is combined with the position regulating shaft to interlockingly rotate the position regulating shaft when the first rotating body transporting member is rotating in a spacing rotation direction from the contacting position to the spacing position and to release the position regulating shaft from interlocking rotation when the first rotating body transporting member is rotating in a reverse spacing rotation direction, and the second rotating body transporting member is combined with the position regulating shaft to receive the spacing external force from the position regulating shaft.

7. An image forming apparatus comprising:

a contacted member;

a rotating body that contacts and is spaced away from the contacted member;

in a single body, a first and a second rotating body transporting members where a supporting part to rotatably support the rotating body, a contacting external force receiving part to receive a contacting external force that contacts the rotating body with the contacted member, and a spacing external force receiving part to receive a spacing external force that spaces the rotating body away from the contacted member, the first and second rotating body transporting members supporting opposite end portions of the rotating shaft of the rotating body, respectively; a driver that drives the first rotating body transporting member; and a position regulating shaft that is inserted into the first and the second rotating body transporting members and is rotatable on the position regulating axis parallel with the rotating shaft of the rotating body, the first rotating body transporting member contacting the position regulating shaft to rotate the position regulating shaft after the first rotating body transporting member is rotated by the driver by a predetermined angle, and then the second rotating body transporting member being interlockingly rotated by the position regulating shaft.

8. The image forming apparatus according to claim 7, wherein the first and the second rotating body transporting members rotatably reciprocate between a contacting position where the rotating body contacts the contacted member and a spacing position where the rotating body is spaced away from the contacted member on the position regulating axis.

9. The image forming apparatus according to claim 7, wherein the first and second rotating body transporting members are combined with the position regulating shaft to be rotatable separately at the contacting position.

10. The image forming apparatus according to claim 9, wherein the driver comprises first and second elastic members that elastically push the first and second rotating body transporting members to the contacting position, respectively; and a pressing member that selectively presses one of the first and second rotating body transporting members to the spacing position.

11. The image forming apparatus according to claim 7, wherein the driver comprises first and second elastic members that elastically push the first and second rotating body transporting members to the contacting position, respectively; and first and second pressing members that selectively press one of the first and second rotating body transporting members to the spacing position, respectively.

12. An image forming apparatus comprising:

a contacted member;

a rotating body that contacts and is spaced away from the contacted member;

in a single body, a rotating body transporting member where a supporting part to rotatably support the rotating body, a contacting external force receiving part to receive a contacting external force that contacts the rotating body with the contacted member, and a spacing external force receiving part to receive a spacing external force that spaces the rotating body away from the contacted member;

a driver that drives the rotating body transporting member; and a position regulating shaft that is rotatable on a position regulating axis parallel with a rotating shaft of the rotating body, wherein the rotating body transporting member rotatably reciprocates between a contacting position where the rotating body contacts the contacted member and a spacing position where the rotating body is spaced away from the contacted member on the position regulating axis, wherein the rotating body transporting member comprises first and second rotating body transporting members that support opposite end portions of the rotating shaft of the rotating body, respectively, wherein the first rotating body transporting member is combined with the position regulating shaft to interlockingly rotate the position regulating shaft when the first rotating body transporting member is rotating in a spacing rotation direction from the contacting position to the spacing position and then to release the position regulating shaft from interlocking rotation when the first rotating body transporting member is rotating in a reverse spacing rotation direction, and the second rotating body transporting member is combined with the position regulating shaft to receive the spacing external force from the position regulating shaft.

13. The image forming apparatus according to claim 12, wherein the position regulating shaft comprises a first surface contacting part, and the first rotating body transporting member comprises a first shaft inserting part that has a first inserting space where the first surface contacting part is inserted; and a first contacting protrusion formed in an inner circumference of the first inserting space to come in and out of contact with the first surface contacting part when the first contacting protrusion is rotating in the spacing rotation direction and in the reverse spacing rotation direction, respectively.

14. The image forming apparatus according to claim 13, wherein the first contacting protrusion and the first surface contacting part are spaced away from each other so that the first and second rotating body transporting members rotate separately at the contacting position.

15. An image forming apparatus comprising:

a transferring belt;

a transferring roller that alternately approaches to and is spaced away from the transferring belt;

in a single body, a first and a second roller transporting members where a supporting part to rotatably support the transferring roller, an approaching external force receiving part to receive a approaching external force that make the transferring roller approach to the transferring belt, and a spacing external force receiving part to receive a spacing external force that spaces the transferring roller away from the transferring belt are formed, the first and the second roller transporting members supporting opposite end portions of a rotating shaft of the transferring roller;

a driver that drives the first roller transporting member; and a position regulating shaft that is inserted into the first and the second roller transporting members and is rotatable on a position regulating axis parallel with the rotating shaft of the transferring roller, the first transferring roller transporting member contacting the position regulating shaft to rotate the position regulating shaft after the first transferring roller transporting member is rotated by the driver by a predetermined angle, and then the second transferring roller transporting member being interlockingly rotated by the position regulating shaft.

16. The image forming apparatus of claim 15, wherein a toner image is applied to the transferring belt, and the transferring roller transfers the toner image to a printing medium interposed between the transferring belt and the transferring roller.

* * * * *